US006218354B1

(12) United States Patent
Demeyere et al.

(10) Patent No.: US 6,218,354 B1
(45) Date of Patent: Apr. 17, 2001

(54) PROCESS FOR MAKING A LIQUID FABRIC SOFTENING COMPOSITION

(75) Inventors: Hugo Jean Marie Demeyere, Merchtem; Johan De Poortere, Merelbeke, both of (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/555,588

(22) PCT Filed: Dec. 3, 1998

(86) PCT No.: PCT/US98/25668

§ 371 Date: Jun. 1, 2000

§ 102(e) Date: Jun. 1, 2000

(87) PCT Pub. No.: WO99/29823

PCT Pub. Date: Jun. 17, 1999

(30) Foreign Application Priority Data

Dec. 10, 1997 (EP) ..... 97870199

(51) Int. Cl.[7] ..... C11D 1/835; C11D 1/825

(52) U.S. Cl. ..... 510/527

(58) Field of Search ..... 510/515, 527

(56) References Cited

U.S. PATENT DOCUMENTS

| | | | | |
|---|---|---|---|---|
| 4,454,049 | * | 6/1984 | MacGlip et al. | 252/8.8 |
| 5,089,148 | | 2/1992 | Van Blarcom et al. | 252/8.6 |
| 5,409,621 | * | 4/1995 | Ellis et al. | 252/8.8 |

FOREIGN PATENT DOCUMENTS

| | | |
|---|---|---|
| 2911198 | 9/1980 | (DE) . |
| WO 94/10285 | 5/1994 | (WO) . |

* cited by examiner

*Primary Examiner*—John Hardee
(74) *Attorney, Agent, or Firm*—Frank C. Turner; Kim W. Zerby; T. David Reed

(57) ABSTRACT

There is provided a process for preparing a liquid softening composition comprising a fabric softener, a nonionic alkoxylated stabilizing agent, and a dye component, whereby the resulting softening composition exhibits effective freeze-thaw recovery properties and good dye homogeneity.

7 Claims, No Drawings

PROCESS FOR MAKING A LIQUID FABRIC SOFTENING COMPOSITION

FIELD OF THE INVENTION

The present invention relates to a process for preparing a dye containing softening composition having effective freeze-thaw recovery properties.

BACKGROUND OF THE INVENTION

Fabric softening products are known in the art to provide effective softness to the treated fabrics. However, a problem encountered upon storage at low temperature, i.e. at sub 0° C. temperature, is the freezing of the product which, when placed at higher temperatures results in a product which does not recover to a uniform dispersion with acceptable flow characteristics.

Accordingly, it is an object of the invention to provide a fabric softening product which has effective freeze-thaw recovery.

One solution to fulfill such need is described in GB-1, 098,793 with the use of sulphate salts of fatty amines in fabric softening compositions.

Still another solution is described in EP-A-0,507,478 which provides the mixing and melting of the cationic fabric softener with a nonionic stabilising agent before dispersing it in water. However, a problem encountered with such a process is that processing equipment such as high shear mixers are needed so that the resulting cost of the formulation is increased.

Accordingly, it is also an object of the invention to provide a fabric softening product which only necessitates minimal processing equipment.

It has been observed that without high shear during the processing of a fabric softening product, the formation of dye speckles arises, whilst with high shear the formation of undispersed dye particles in the fabric softening product is avoided.

Accordingly, the formulator of a softening composition is faced with the dual challenge of formulating a softening composition which has good dye homogeneity, without the need for a high shear mixing equipment.

The Applicant has now found that the addition of the dye component together with a nonionic alkoxylated surfactant to the finished cold softening product fulfills such needs.

Indeed, application of the dye and nonionic alkoxylated surfactant to the cold finished product is made by simple mixing. The composition obtained results in an homogenous dispersion.

An advantage of the invention is that for resulting fabric softening products in diluted form made by the invention process, less mechanical shear is required compared to products made by mixing the fabric softener and nonionic before dispersion in water. Not to be bound by theory, it is believed that the nonionic surfactant micellizes the dye and subsequently forms mixed vesicles with the softener active. In this manner the dye is efficiently dispersed and the product acquires good freeze thaw recovery.

SUMMARY OF THE INVENTION

The present invention relates to a process for making a liquid fabric softening composition which comprises the steps of:

a)-mixing and heating the fabric softener active and optional additives to form a melt;

b)-dispersing the melt in water;

c)-cooling the resulting dispersion to below the Krafft temperature of the softener active before adding a dye and a nonionic alkoxylated stabilising agent.

In another aspect, the present invention encompasses the use of a nonionic alkoxylated stabilising agent in liquid fabric softening compositions as a freeze-thaw recovery agent.

Still in another aspect, the present invention encompasses the use of a nonionic alkoxylated stabilising agent to homogenise the dye in liquid fabric softening compositions.

DETAILED DESCRIPTION OF THE INVENTION

Nonionic alkoxylated surfactant

A nonionic alkoxylated stabilising surfactant is an essential component of the process invention. Suitable nonionic surfactants for use herein include addition products of ethylene oxide with fatty alcohols, fatty acids, fatty amines, etc. Optionally, addition products of propylene oxide with fatty alcohols, fatty acids, fatty amines may be used.

Suitable compounds are surfactants of the general formula:

$$R^2—Y—(C_2H_4O)_z—C_2H_4OH$$

wherein $R^2$ is selected from the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups preferably having a hydrocarbyl chain length of from 8 to 20, preferably from 10 to 18 carbon atoms. More preferably the hydrocarbyl chain length is from 12 to 18 carbon atoms. In the general formula for the ethoxylated nonionic surfactants herein, Y is —O—, —C(O)O—, —C(O)N(R)—, or —C(O)N(R)R—, in which R, when present, is $R^2$ or hydrogen, and z is at least 5, preferably at least 8.

The nonionic surfactants herein are characterised by an HLB (hydrophilic-lipophilic balance) of from 7 to 20, preferably from 8 to 15. Of course, by defining $R^2$ and the number of ethoxylate groups, the HLB of the surfactant is, in general, determined. However, it is to be noted that the nonionic ethoxylated surfactants useful herein contain relatively long chain $R^2$ groups and are relatively highly ethoxylated. While shorter alkyl chain surfactants having short ethoxylated groups may possess the requisite HLB, they are not as effective herein.

Examples of nonionic surfactants follow. The nonionic surfactants of this invention are not limited to these examples. In the examples, the integer defines the number of ethoxyl (EO) groups in the molecule.

a. Straight-Chain, Primary Alcohol Alkoxylates

The tri-, penta-, hepta-ethoxylates of dodecanol, and tetradecanol are useful surfactants in the context of this invention. The ethoxylates of mixed natural or synthetic alcohols in the "coco" chain length range are also useful herein. Commercially available straight-chain, primary alcohol alkoxylates for use herein are available under the tradename Marlipal® 24/70, Marlipal 24/100, Marlipal 24/150 from Huls, and Genapol® C-050 from Hoechst.

b. Straight-Chain, Secondary Alcohol Alkoxylates

The tri-, penta-, hepta-ethoxylates of 3-hexadecanol, 2-octadecanol, 4-eicosanol, and 5-eicosanol are useful surfactants in the context of this invention. A commercially available straight-chain secondary alcohol ethoxylate for use herein is the material marketed under the tradename Tergitol 15-S-7 from Union Carbide, which comprises a mixture of secondary alcohols having an average hydrocarbyl chain length of 11 to 15 carbon atoms condensed with an average 7 moles of ethylene oxide per mole equivalent of alcohol.

c. Alkyl Phenol Alkoxylates

Suitable alkyl phenol alkoxylates are the polyethylene oxide condensates of alkyl phenols, e.g., the condensation products of alkyl phenols having an alkyl or alkenyl group containing from 6 to 20 carbon atoms in a primary, secondary or branched chain configuration, preferably from 8 to 12 carbon atoms, with ethylene oxide, the said ethylene oxide being preferably present in amounts equal to 3 to less than 9 moles of ethylene oxide per mole of alkyl phenol. The alkyl substituent in such compounds may be derived from polymerized propylene, diisobutylene, octane, and nonane.

Examples of this type of nonionic surfactants include Triton N-57® a nonyl phenol ethoxylate (5EO) from Rohm & Haas, Dowfax® 9N5 from Dow and Lutensol® AP6 from BASF.

d. Olefinic Alkoxylates

The alkenyl alcohols, both primary and secondary, and alkenyl phenols corresponding to those disclosed immediately hereinabove can be ethoxylated and used as surfactants.

Commercially available olefinic alkoxylates for use herein are available under the tradename Genapol O-050 from Hoechst.

e. Branched Chain Alkoxylates

Branched chain primary and secondary alcohols which may be available from the well-known "OXO" process or modification thereof can be ethoxylated. Particularly preferred among these ethoxylates of the primary OXO alcohols are the surfactants marketed under the name Lutensol by BASF or Dobanol by the Shell Chemicals, U.K., LTD. The preferred Dobanols are primary alcohols with hydrocarbyl groups of 9 to 15 carbon atoms, with the majority having a hydrocarbyl group of 13 carbon atoms. Particularly preferred are Dobanols with an average degree of ethoxylation of 3 to less than 9, and preferably 5 on the average.

An example of this type of material is an aliphatic alcohol ethylene oxide condensate having from 3 to less than 9 moles of ethylene oxide per mole of aliphatic alcohol, the aliphatic alcohol fraction having from 9 to 14 carbon atoms. Other examples of this type of nonionic surfactants include certain of the commercially available Dobanol®, Neodol® marketed by Shell or Lutensol® from BASF. For example Dobanol® 23.5 (C12-C13 EO5), Dobanol® 91.5 (C9-C11 EO 5) and Neodol 45 E5.

Other suitable nonionic alkoxylated surfactants are alkyl amines alkoxylated with at least 5 alkoxy moieties. Typical of this class of compounds are the surfactants derived from the condensation of ethylene oxide with an hydrophobic alkyl amine product. Preferably the hydrophobic alkyl group, has from 6 to 22 carbon atoms. Preferably, the alkyl amine is alkoxylated with 10 to 40, and more preferably 20 to 30 alkoxy moieties.

Example of this type of nonionic surfactants are the alkyl amine ethoxylate commercially available under the tradename Genamin from Hoechst. Suitable example for use herein are Genamin C-100, Genamin O-150, and Genamin S-200.

Still other suitable type of nonionic surfactant among this class are the N,N',N'-polyoxyethylene (12)-N-tallow 1,3 diaminopropane commercialised under the tradename Ethoduomeen T22 from Akzo, and Synprolam from ICI.

The above ethoxylated nonionic surfactants are useful in the present process invention alone or in combination, and the term "nonionic surfactant" encompasses mixed nonionic surface active agents.

Preferred nonionic surfactants for use herein are the nonionic surfactants commercially available under the tradenames Marlipal 24/100, Marlipal 24/150, Genapol O-050, and Dobanol 91.5.

The nonionic surfactant will preferably be added in an amount of 0.05% to 5% by weight, preferably from 0.1% to 0.5% by weight of the finished fabric softening composition.

The Dye Component

The dye is an essential component of the invention. Hence, by mixed the dye together with the nonionic alkoxylated surfactants and subsequently incorporating it into the cold finished product, it has been observed that the formation of dyes speckles which occurs by incorporation of the dyes into the molten fabric softening product is suppressed and/or reduced by the process of the invention.

Preferred dye components are the water-soluble dye such as described in EP 754749.

Preferably, the dye is a water soluble dye system characterised in that the dye system comprises a dye selected from the group consisting of:

1. Quinoline Yellow 70 with color index no. 47005;
2. Tartrazine XX90 with color index no. 19140;
3. Orange RGL90 with color index no. 15985;
4. Ponceau 4RC82 with color index no. 16255;
5. Blue AE85 with color index no. 42090;
6. Patent Blue V85V50 with color index no. 42051; and
7. mixtures thereof.

The dye will preferably be added in an amount of 1 ppm to 200 ppm by weight, preferably from 5 ppm to 100 ppm by weight of the finished fabric softening composition.

The finished fabric softening composition conventionally comprises a cationic fabric softener and optional additives.

Fabric Softener

Typical levels of incorporation of the softening compound in the softening composition are of from 1% to 80% by weight, preferably from 5% to 75%, more preferably from 15% to 70%, and even more preferably from 19% to 65%, by weight of the composition.

The fabric softener compound is preferably selected from a cationic, nonionic, amphoteric or anionic fabric softening component. Typical of the cationic softening components are the quaternary ammonium compounds or amine precursors thereof as defined hereinafter.

A)-Quaternary Ammonium Fabric Softening Active Compound (1) Preferred quaternary ammonium fabric softening active compound have the formula $$\left[(R)_{4-m}-\overset{+}{N}-\left[(CH_2)_n-Q-R^1\right]_m\right] X^- \quad (1)$$

or the formula:

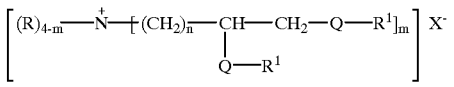

(2)

wherein Q is a carbonyl unit having the formula:

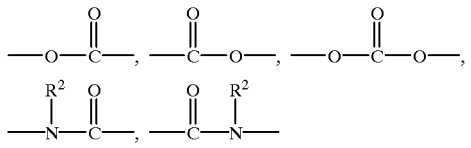

each R unit is independently hydrogen, $C_1$–$C_6$ alkyl, $C_1$–$C_6$ hydroxyalkyl, and mixtures thereof, preferably methyl or hydroxy alkyl; each $R^1$ unit is independently linear or branched $C_{11}$–$C_{22}$ alkyl, linear or branched $C_{11}$–$C_{22}$ alkenyl, and mixtures thereof, $R^2$ is hydrogen, $C_1$–$C_4$ alkyl, $C_1$–$C_4$ hydroxyalkyl, and mixtures thereof; X is an anion which is compatible with fabric softener actives and adjunct ingredients; the index m is from 1 to 4, preferably 1; the index n is from 1 to 4, preferably 2.

An example of a preferred fabric softener active is a mixture of quaternized amines having the formula:

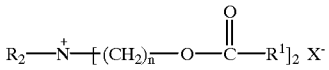

wherein R is preferably methyl; $R^1$ is a linear or branched alkyl or alkenyl chain comprising at least 11 atoms, preferably at least 15 atoms. In the above fabric softener example, the unit $—O_2CR^1$ represents a fatty acyl unit which is typically derived from a triglyceride source. The triglyceride source is preferably derived from tallow, partially hydrogenated tallow, lard, partially hydrogenated lard, vegetable oils and/or partially hydrogenated vegetable oils, such as, canola oil, safflower oil, peanut oil, sunflower oil, corn oil, soybean oil, tall oil, rice bran oil, etc. and mixtures of these oils.

The preferred fabric softening actives of the present invention are the Diester and/or Diamide Quaternary Ammonium (DEQA) compounds, the diesters and diamides having the formula:

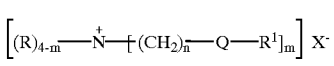

wherein R, $R^1$, X, and n are the same as defined herein above for formulas (1) and (2), and Q has the formula:

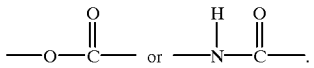

These preferred fabric softening actives are formed from the reaction of an amine with a fatty acyl unit to form an amine intermediate having the formula:

wherein R is preferably methyl, Q and $R^1$ are as defined herein before; followed by quaternization to the final softener active.

Non-limiting examples of preferred amines which are used to form the DEQA fabric softening actives according to the present invention include methyl bis(2-hydroxyethyl) amine having the formula:

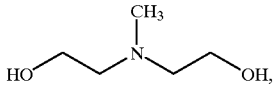

methyl bis(2-hydroxypropyl)amine having the formula:

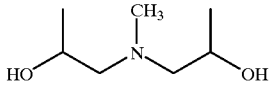

methyl(3-aminopropyl)(2-hydroxyethyl)amine having the formula:

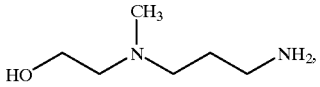

methyl bis(2-aminoethyl)amine having the formula:

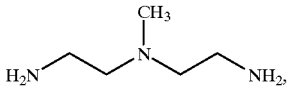

triethanol amine having the formula:

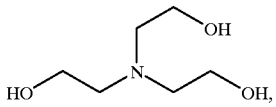

di(2-aminoethyl)ethanolamine having the formula:

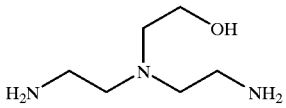

The counterion, X(⁻) above, can be any softener-compatible anion, preferably the anion of a strong acid, for example, chloride, bromide, methylsulfate, ethylsulfate, sulfate, nitrate and the like, more preferably chloride or methyl sulfate. The anion can also, but less preferably, carry a double charge in which case X(⁻) represents half a group.

Tallow and canola oil are convenient and inexpensive sources of fatty acyl units which are suitable for use in the present invention as $R^1$ units. The following are non-limiting examples of quaternary ammonium compounds suitable for use in the compositions of the present invention. The term "tallowyl" as used herein below indicates the $R^1$ unit is derived from a tallow triglyceride source and is a mixture of fatty acyl units. Likewise, the use of the term canolyl refers to a mixture of fatty acyl units derived from canola oil.

Table II

Fabric Softener Actives

N,N-di(tallowyl-oxy-ethyl)-N,N-dimethyl ammonium chloride;

N,N-di(canolyl-oxy-ethyl)-N,N-dimethyl ammonium chloride;

N,N-di(tallowyl-oxy-ethyl)-N-methyl, N-(2-hydroxyethyl) ammonium chloride;

N,N-di(canolyl-oxy-ethyl)-N-methyl, N-(2-hydroxyethyl) ammonium chloride;

N,N-di(2-tallowyloxy-2-oxo-ethyl)-N,N-dimethyl ammonium chloride;

N,N-di(2-canolyloxy-2-oxo-ethyl)-N,N-dimethyl ammonium chloride

N,N-di(2-tallowyloxyethylcarbonyloxyethyl)-N,N-dimethyl ammonium chloride;

N,N-di(2-canolyloxyethylcarbonyloxyethyl)-N,N-dimethyl ammonium chloride;

N-(2-tallowoyloxy-2-ethyl)-N-(2-tallowyloxy-2-oxo-ethyl)-N,N-dimethyl ammonium chloride;

N-(2-canolyloxy-2-ethyl)-N-(2-canolyloxy-2-oxo-ethyl)-N,N-dimethyl ammonium chloride;

N,N,N-tri(tallowyl-oxy-ethyl)-N-methyl ammonium chloride;

N,N,N-tricanolyl-oxy-ethyl)-N-methyl ammonium chloride;

N-(2-tallowyloxy-2-oxoethyl)-N-(tallowyl)-N,N-dimethyl ammonium chloride;

N-(2-canolyloxy-2-oxoethyl)-N-(canolyl)-N,N-dimethyl ammonium chloride;

1,2-ditallowyloxy-3-N,N,N-trimethylammoniopropane chloride; and 1,2-dicanolyloxy-3-N,N,N-trimethylammoniopropane chloride;

and mixtures of the above actives.

Other examples of quaternay ammoniun softening compounds are methylbis(tallowamidoethyl)(2-hydroxyethyl) ammonium methylsulfate and methylbis(hydrogenated tallowamidoethyl)(2-hydroxyethyl)ammonium methylsulfate; these materials are available from Witco Chemical Company under the trade names Varisoft® 222 and Varisoft® 110, respectively.

Particularly preferred is N,N-di(tallowoyl-oxy-ethyl)-N,N-dimethyl ammonium chloride, where the tallow chains are at least partially unsaturated.

The level of unsaturation contained within the tallow, canola, or other fatty acyl unit chain can be measured by the Iodine Value (IV) of the corresponding fatty acid, which in the present case should preferably be in the range of from 5 to 100 with two categories of compounds being distinguished, having a IV below or above 25.

Indeed, for compounds having the formula:

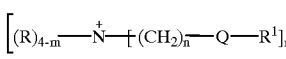

derived from tallow fatty acids, when the Iodine Value is from 5 to 25, preferably 15 to 20, it has been found that a cis/trans isomer weight ratio greater than about 30/70, preferably greater than about 50/50 and more preferably greater than about 70/30 provides optimal concentrability. For compounds of this type made from tallow fatty acids having a Iodine Value of above 25, the ratio of cis to trans isomers has been found to be less critical unless very high concentrations are needed.

Other suitable examples of fabric softener actives are derived from fatty acyl groups wherein the terms "tallowyl" and canolyl" in the above examples are replaced by the terms "cocoyl, palmyl, lauryl, oleyl, ricinoleyl, stearyl, palmityl," which correspond to the triglyceride source from which the fatty acyl units are derived. These alternative fatty acyl sources can comprise either fully saturated, or preferably at least partly unsaturated chains.

As described herein before, R units are preferably methyl, however, suitable fabric softener actives are described by replacing the term "methyl" in the above examples in Table II with the units "ethyl, ethoxy, propyl, propoxy, isopropyl, butyl, isobutyl and t-butyl.

The counter ion, X, in the examples of Table II can be suitably replaced by bromide, methylsulfate, formate, sulfate, nitrate, and mixtures thereof. In fact, the anion, X, is merely present as a counterion of the positively charged quaternary ammonium compounds. The scope of this invention is not considered limited to any particular anion.

For the preceding ester fabric softening agents, the pH of the compositions herein is an important parameter of the present invention. Indeed, it influences the stability of the quaternary ammonium or amine precursors compounds, especially in prolonged storage conditions.

The pH, as defined in the present context, is measured in the neat compositions at 20° C. While these compositions are operable at pH of less than about 6.0, for optimum hydrolytic stability of these compositions, the neat pH, measured in the above-mentioned conditions, must preferably be in the range of from about 2.0 to about 5, preferably in the range of 2.5 to 4.5, preferably about 2.5 to about 3.5. The pH of these compositions herein can be regulated by the addition of a Bronsted acid.

Examples of suitable acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids.

As used herein, when the diester is specified, it will include the monoester that is normally present in manufacture. For softening, under no/low detergent carry-over laundry conditions the percentage of monoester should be as low as possible, preferably no more than about 2.5%. However, under high detergent carry-over conditions, some monoester is preferred. The overall ratios of diester to monoester are from about 100:1 to about 2:1, preferably from about 50:1 to about 5:1, more preferably from about 13:1 to about 8:1. Under high detergent carry-over conditions, the di/monoester ratio is preferably about 11:1. The level of monoester present can be controlled in the manufacturing of the softener compound.

Mixtures of actives of formula (1) and (2) may also be prepared.

2)-Still other suitable quaternary ammonium fabric softening compounds for use herein are cationic nitrogenous salts having two or more long chain acyclic aliphatic $C_8$–$C_{22}$ hydrocarbon groups or one said group and an arylalkyl group which can be used either alone or as part of a mixture are selected from the group consisting of:

(i) acyclic quaternary ammonium salts having the formula:

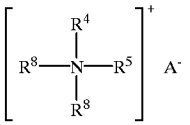

wherein $R^4$ is an acyclic aliphatic $C_8$–$C_{22}$ hydrocarbon group, $R^5$ is a $C_1$–$C_4$ saturated alkyl or hydroxyalkyl group, $R^8$ is selected from the group consisting of $R^4$ and $R^5$ groups, and A– is an anion defined as above;

(ii) diamino alkoxylated quaternary ammonium salts having the formula:

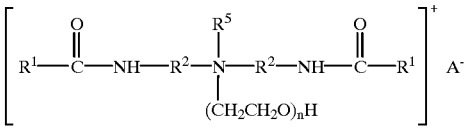

wherein n is equal to 1 to about 5, and $R^1$, $R^2$, $R^5$ and $A^-$ are as defined above;

(iii) mixtures thereof.

Examples of the above class cationic nitrogenous salts are the well-known dialkyldi methylammonium salts such as ditallowdimethylammonium chloride, ditallowdimethylammonium methylsulfate, di(hydrogenatedtallow) dimethylammonium chloride, distearyidimethylammonium chloride, dibehenyidimethylammonium chloride. Di(hydrogenatedtallow)di methylammonium chloride and ditallowdimethylammonium chloride are preferred. Examples of commercially available dialkyldimethyl ammonium salts usable in the present invention are di(hydrogenatedtallow)dimethylammonium chloride (trade name Adogen® 442), ditallowdimethylammonium chloride (trade name Adogen® 470, Praepagen® 3445), distearyl dimethylammonium chloride (trade name Arosurf® TA-100), all available from Witco Chemical Company. Dibehenyldimethylammonium chloride is sold under the trade name Kemamine Q-2802C by Humko Chemical Division of Witco Chemical Corporation. Dimethylstearylbenzyl ammonium chloride is sold under the trade names Varisoft® SDC by Witco Chemical Company and Ammonyx® 490 by Onyx Chemical Company.

B)-Amine Fabric Softening Active Compound

Suitable amine fabric softening compounds for use herein, which may be in amine form or cationic form are selected from:

(i)-Reaction products of higher fatty acids with a polyamine selected from the group consisting of hydroxyalkylalkylenediamines and dialkylenetriamines and mixtures thereof. These reaction products are mixtures of several compounds in view of the multi-functional structure of the polyamines. The preferred Component (i) is a nitrogenous compound selected from the group consisting of the reaction product mixtures or some selected components of the mixtures. One preferred component (i) is a compound selected from the group consisting of substituted imidazoline compounds having the formula:

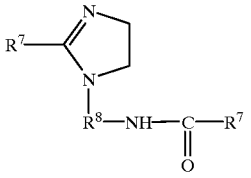

wherein $R^7$ is an acyclic aliphatic $C_{15}$–$C_{21}$ hydrocarbon group and $R^8$ is a divalent $C_1$–$C_3$ alkylene group.

Component (i) materials are commercially available as: Mazamide® 6, sold by Mazer Chemicals, or Ceranine® HC, sold by Sandoz Colors & Chemicals; stearic hydroxyethyl imidazoline sold under the trade names of Alkazine® ST by Alkaril Chemicals, Inc., or Schercozoline® S by Scher Chemicals, Inc.; N,N"-ditallowalkoyidiethylenetriamine; 1-tallowamidoethyl-2-tallowimidazoline (wherein in the preceding structure $R^1$ is an aliphatic $C_{15}$–$C_{17}$ hydrocarbon group and $R^8$ is a divalent ethylene group).

Certain of the Components (i) can also be first dispersed in a Bronsted acid dispersing aid having a pKa value of not greater than about 4; provided that the pH of the final composition is not greater than about 6. Some preferred dispersing aids are hydrochloric acid, phosphoric acid, or methylsulfonic acid.

Both N,N"-ditallowalkoyldiethylenetriamine and 1-tallow(amidoethyl)-2-tallowimidazoline are reaction products of tallow fatty acids and diethylenetriamine, and are precursors of the cationic fabric softening agent methyl-1-tallowamidoethyl-2-tallowimidazolinium methylsulfate (see "Cationic Surface Active Agents as Fabric Softeners," R. R. Egan, Journal of the American Oil Chemical' Society, January 1978, pages 118–121). N,N"-ditallow alkoyldiethylenetriamine and 1-tallowamidoethyl-2-tallowimidazoline can be obtained from Witco Chemical Company as experimental chemicals. Methyl-1-tallowamidoethyl-2-tallowimidazolinium methylsulfate is sold by Witco Chemical Company under the tradename Varisoft® 475.

(ii)-softener having the formula:

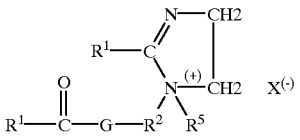

wherein each $R^2$ is a $C_{1-6}$ alkylene group, preferably an ethylene group; and G is an oxygen atom or an —NR— group; and each R, $R^1$, $R^2$ and $R^5$ have the definitions given above and $A^-$ has the definitions given above for $X^-$.

An example of Compound (ii) is 1-oleylamidoethyl-2-oleylimidazolinium chloride wherein $R^1$ is an acyclic aliphatic $C_{15}$–$C_{17}$ hydrocarbon group, $R^2$ is an ethylene group, G is a NH group, $R^5$ is a methyl group and $A^-$ is a chloride anion.

(iii)-softener having the formula:

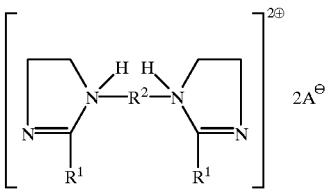

wherein R, $R^1$, $R^2$, and $A^-$ are defined as above.

An example of Compound (iii) is the compound having the formula:

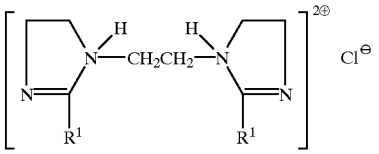

wherein $R^1$ is derived from oleic acid.

Additional fabric softening agents useful herein are described in U.S. Pat. No. 4,661,269, issued Apr. 28, 1987, in the names of Toan Trinh, Errol H. Wahl, Donald M. Swartley, and Ronald L. Hemingway; U.S. Pat. No. 4,439,335, Burns, issued Mar. 27, 1984; and in U.S. Pat. No. 3,861,870, Edwards and Diehl; U.S. Pat. No. 4,308,151, Cambre; U.S. Pat. No. 3,886,075, Bernardino; U.S. Pat. No. 4,233,164, Davis; U.S. Pat. No. 4,401,578, Verbruggen; U.S. Pat. No. 3,974,076, Wiersema and Rieke; U.S. Pat. No. 4,237,016, Rudkin, Clint, and Young; and European Patent Application publication No. 472,178, by Yamamura et al., all of said documents being incorporated herein by reference.

Of course, the term "softening active" can also encompass mixed softening active agents.

Preferred among the classes of softener compounds disclosed herein before are the diester or diamido quaternary ammonium fabric softening active compound (DEQA).

Another conventional optional ingredient of said liquid fabric softening compositions is a liquid carrier. Suitable liquid carriers are selected from water, organic solvents and mixtures thereof. The liquid carrier employed in the instant compositions is preferably at least primarily water due to its low cost relative availability, safety, and environmental compatibility. The level of water in the liquid carrier is preferably at least 50%, most preferably at least 60%, by weight of the carrier. Mixtures of water and low molecular weight, e.g., <200, organic solvent, e.g., lower alcohol such as ethanol, propanol, isopropanol or butanol are useful as the carrier liquid. Low molecular weight alcohols include monohydric, dihydric (glycol, etc.) trihydric (glycerol, etc.), and higher polyhydric (polyols) alcohols.

Optional Components

The composition may also optionally contain additional components such as pH modifiers, perfumes, chelating agents, cationic surfactant concentration aids, electrolyte concentration aids, thickeners, stabilisers, such as well known antioxidants and reductive agents, soil release polymers, emulsifiers, bacteriocides, colorants, preservatives, optical brighteners, anti ionisation agents, antifoam agents, enzymes, dye fixing agent such as polyquaternary ammonium compounds (e.g. Sandofix WE56 commercially available from Hoechst, or Rewin SFR commercially available from CHT R. Beitlich), polyamino functional polymer such as disclosed in co-pending application EP 97201488.0, dispersible polyolefin such as Velustrol® as disclosed in co-pending application PCT/US 97/01644, and the like. A typical amount of such optional components will be from 0% to 15% by weight.

Perfume

The word perfume encompasses individual perfume components and compositions of perfume components. Selection of any perfume is based solely on aesthetic considerations.

Perfume, in the sense of perfume components or compositions of perfume components, can be any odoriferous materials or any materials which act as a malodour counteractent. The perfume will most often be liquid at ambient temperatures, but also can be liquified solid such as the various camphoraceous perfumes known in the art. The perfume can be relatively simple in composition or can comprise highly sophisticated, compact mixtures of natural or synthetic chemical components, all chosen to provide any desired odour.

Useful perfumes are those odorous materials that deposit on fabrics during the laundry process and are detectable by people with normal olfactory sensity. Many of the perfume ingredients along with their odor corrector and their physical and chemical properties are given in "Perfume and Flavor chemicals (aroma chemicals)", Stephen Arctender, Vols. I and II, Aurthor, Montclair, H. J. and the Merck Index, 8th Edition, Merck & Co., Inc. Rahway, N.J. Perfume components and compositions can also be found in the art, e.g. U.S. Pat. Nos. 4,145,184, 4,152,272, 4,209,417 or 4,515,705.

A wide variety of chemicals are known for perfume use including materials such as aldehydes, ketones, esters and the like. More commonly, naturally occurring plant and animal oils and exudates comprising complex mixtures of various chemical components are known for use as perfume, and such materials can be used herein. Typical perfumes can comprise e.g. woody/earthy bases containing exotic materials such as sandalwood oil, civet and patchouli oil. The perfume also can be of a light floral fragrance e.g. rose or violet extract. Further the perfume can be formulated to provide desirable fruity odours e.g. lime, lemon or orange.

Particular examples of useful perfume components and compositions are anetole, benzaldehyde, benzyl acetate, benzyl alcohol, benzyl formate, iso-bornyl acetate, camphene, cis-citral (neral), citronellal, citronellol, citronellyl acetate, paracymene, decanal, dihydrolinalool, dihydromyrcenol, dimethyl phenyl carbinol, eucalyptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, alpha-methyl ionone, methyl nonyl acetaldehyde, methyl phenyl carbinyl acetate, laevo-menthyl acetate, menthone, iso-menthone, myrcene, myrcenyl acetate, myrcenol, nerol, neryl acetate, nonyl acetate, phenyl ethyl alcohol, alpha-pinene, beta-pinene, gamma-terpinene, alpha-terpineol, beta-terpineol, terpinyl acetate, vertenex (para-tertiary-butyl cyclohexyl acetate), amyl cinnamic aldehyde, iso-amyl salicylate, beta-caryophyllene, cedrene, cinnamic alcohol, couramin, dimethyl benzyl carbinyl acetate, ethyl vanillin, eugenol, iso-eugenol, flor acetate, heliotrophine, 3-cis-hexenyl salicylate, hexyl salicylate, lilial (para-tertiarybutyl-alpha-methyl hydrocinnamic aldehyde), gamma-methyl ionone, nerolidol, patchouli alcohol, phenyl hexanol, beta-selinene, trichloromethyl phenyl carbinyl acetate, triethyl citrate, vanillin, veratraldehyde, alpha-cedrene, beta-cedrene, C15H24sesquiterpenes, benzophenone, benzyl salicylate, ethylene brassylate, galaxolide (1,3,4,6,7,8-hexahydro-4,6,6,7,8,8,-hexamethyl-cyclo-penta-gamma-2-benzopyran), hexyl cinnamic aIdehyde, lyral (4-(4-hydroxy4-methyl pentyl)-3-cyclohexene-10-carboxaldehyde), methyl cedrylone, methyl dihydro jasmonate, methyl-beta-naphthyl ketone, musk ambrette, musk idanone, musk ketone, musk tibetine, musk xylol, aurantiol and phenylethyl phenyl acetate.

Perfume can be present at a level of from 0% to 10%, preferably from 0.1% to 5%, and more preferably from 0.2% to 3%, by weight of the finished composition. Fabric softener compositions of the present invention provide improved fabric perfume deposition.

Additional Components

Concentration Aids

Concentrated compositions of the present invention may require organic and/or inorganic concentration aids to go to even higher concentrations and/or to meet higher stability standards depending on the other ingredients. Surfactant concentration aids are typically selected from the group consisting of single long chain alkyl cationic surfactants; nonionic surfactants; amine oxides; fatty acids; or mixtures thereof, typically used at a level of from 0 to 15% of the composition. Inorganic viscosity/dispersibility control agents which can also act like or augment the effect of the surfactant concentration aids, include water-soluble, ionizable salts which can also optionally be incorporated into the compositions of the present invention. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 20,000 parts per million (ppm), preferably from about 20 to about 11,000 ppm, by weight of the composition.

Alkylene polyammonium salts can be incorporated into the composition to give viscosity control in addition to or in place of the water-soluble, ionizable salts above. In addition, these agents can act as scavengers, forming ion pairs with anionic detergent carried over from the main wash, in the rinse, and on the fabrics, and may improve softness performance. These agents may stabilize the viscosity over a broader range of temperature, especially at low temperatures, compared to the inorganic electrolytes.

Specific examples of alkylene polyammonium salts include l-lysine monohydrochloride and 1,5-diammonium 2-methyl pentane dihydrochloride.

Enzymes

The compositions herein can optionally employ one or more enzymes such as lipases, proteases, cellulase, amylases and peroxidases. A preferred enzyme for use herein is a cellulase enzyme. Indeed, this type of enzyme will further provide a color care benefit to the treated fabric. Cellulases usable herein include both bacterial and fungal types, preferably having a pH optimum between 5 and 9.5. U.S. Pat. No. 4,435,307 discloses suitable fungal cellulases from Humicola insolens or Humicola strain DSM1800 or a cellulase 212-producing fungus belonging to the genus Aeromonas, and cellulase extracted from the hepatopancreas of a marine mollusk, Dolabella Auncula Solander. Suitable cellulases are also disclosed in GB-A-2.075.028; GB-A-2.095.275 and DE-OS-2.247.832. CAREZYME® and CELLUZYME® (Novo) are especially useful. Other suitable cellulases are also disclosed in WO 91/17243 to Novo, WO 96/34092, WO 96/34945 and EP-A-0,739,982. In practical terms for current commercial preparations, typical amounts are up to 5 mg by weight, more typically 0.01 mg to 3 mg, of active enzyme per gram of the detergent composition. Stated otherwise, the compositions herein will typically comprise from 0.001% to 5%, preferably 0.01%–1% by weight of a commercial enzyme preparation. In the particular cases where activity of the enzyme preparation can be defined otherwise such as with cellulases, corresponding activity units are preferred (e.g. CEVU or cellulase Equivalent Viscosity Units). For instance, the compositions of the present invention can contain cellulase enzymes at a level equivalent to an activity from about 0.5 to 1000 CEVU/gram of composition. Cellulase enzyme preparations used for the purpose of formulating the compositions of this invention typically have an activity comprised between 1,000 and 10,000 CEVU/gram in liquid form, around 1,000 CEVU/gram in solid form.

Soil Release Agents

In the present invention, an optional soil release agent can be added. The addition of the soil release agent can occur in combination with the premix, in combination with the acid/water seat, before or after electrolyte addition, or after the final composition is made. The softening composition prepared by the process of the present invention herein can contain from 0% to 10%, preferably from 0.2% to 5%, of a soil release agent. Preferably, such a soil release agent is a polymer.

Any polymeric soil release agent known to those skilled in the art can optionally be employed in the compositions of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

If utilised, soil release agents will generally comprise from about 0.01% to about 10.0%, by weight, of the detergent compositions herein, typically from about 0.1% to about 5%, preferably from about 0.2% to about 3.0%.

The following, all included herein by reference, describe soil release polymers suitable for use in the present invention. U.S. Pat. No. 3,959,230 Hays, issued May 25, 1976; U.S. Pat. No. 3,893,929 Basadur, issued Jul. 8, 1975; U.S. Pat. No. 4,000,093, Nicol, et al., issued Dec. 28, 1976; U.S. Pat. No. 4,702,857 Gosselink, issued Oct. 27, 1987; U.S. Pat. No. 4,968,451, Scheibel et al., issued Nov. 6; U.S. Pat. No. 4,702,857, Gosselink, issued Oct. 27, 1987; U.S. Pat. No. 4,711,730, Gosselink et al., issued Dec. 8, 1987; U.S. Pat. No. 4,721,580, Gosselink, issued Jan. 26, 1988; U.S. Pat. No. 4,877,896, Maldonado et al, issued Oct. 31, 1989; U.S. Pat. No. 4,956,447, Gosselink et al., issued Sep. 11, 1990; U.S. Pat. No. 5,415,807 Gosselink et al., issued May 16, 1995; European Patent Application 0 219 048, published Apr. 22, 1987 by Kud, et al.

Further suitable soil release agents are described in U.S. Pat. No. 4,201,824, Violland et al.; U.S. Pat. No. 4,240,918 Lagasse et al.; U.S. Pat. No. 4,525,524 Tung et al.; U.S. Pat. No. 4,579,681, Ruppert et al.; U.S. Pat. No. 4,240,918; U.S. Pat. No. 4,787,989; U.S. Pat. No. 4,525,524; EP 279,134 A, 1988, to Rhone-Poulenc Chemie; EP 457,205 A to BASF (1991); and DE 2,335,044 to Unilever N. V., 1974 all incorporated herein by reference.

Commercially available soil release agents include the METOLOSE SM100, METOLOSE SM200 manufactured by Shin-etsu Kagaku Kogyo K.K., SOKALAN type of material, e.g., SOKALAN HP-22, available from BASF (Germany), ZELCON 5126 (from Dupont) and MILEASE T (from ICI). These soil release agents can also act as scum dispersants.

Stabilizers

Stabilizers can be present in the compositions of the present invention. The term "stabilizer," as used herein, includes antioxidants and reductive agents. These agents are present at a level of from 0% to about 2%, preferably from about 0.01% to about 0.2%, more preferably from about 0.035% to about 0.1% for antioxidants, and more preferably from about 0.01% to about 0.2% for reductive agents. These assure good odor stability under long term storage conditions for the compositions and compounds stored in molten form. The use of antioxidants and reductive agent stabilizers is especially critical for low scent products (low perfume).

Examples of antioxidants that can be added to the compositions of this invention include a mixture of ascorbic acid, ascorbic palmitate, propyl gallate, available from Eastman Chemical Products, Inc., under the trade names Tenox® PG and Tenox S-1; a mixture of BHT (butylated hydroxytoluene), BHA (butylated hydroxyanisole), propyl gallate, and citric acid, available from Eastman Chemical Products, Inc., under the trade name Tenox-6; butylated hydroxytoluene, available from UOP Process Division under the trade name Sustane® BHT; tertiary butylhydroquinone, Eastman Chemical Products, Inc., as Tenox TBHQ; natural tocopherols, Eastman Chemical Products, Inc., as Tenox GT-1/GT-2; and butylated hydroxyanisole, Eastman Chemical Products, Inc., as BHA; long chain esters (C8–C22) of gallic acid, e.g., dodecyl gallate; Irganox® 1010; Irganox® 1035; Irganox® B 1171; Irganox® 1425; Irganox® 3114; Irganox® 3125; and mixtures thereof; preferably Irganox® 3125, Irganox® 1425, Irganox® 3114, and mixtures thereof; more preferably Irganox® 3125 alone or mixed with citric acid and/or other chelators such as isopropyl citrate, Dequest® 2010, available from Monsanto with a chemical name of 1-hydroxyethylidene-1, 1-diphosphonic acid (etidronic acid), and Tiron®, available from Kodak with a chemical name of 4,5-dihydroxy-m-benzene-sulfonic acid/sodium salt, EDDS, and DTPA®, available from Aldrich with a chemical name of diethylenetriaminepentaacetic acid. The chemical names and CAS numbers for some of the above stabilizers are listed in Table II below.

TABLE II

| Antioxidant | CAS No. | Chemical Name used in Code of Federal Regulations |
|---|---|---|
| Irganox ® 1010 | 6683-19-8 | Tetrakis (methylene(3,5-di-tert-butyl-4 hydroxyhydrocinnamate)) methane |
| Irganox ® 1035 | 41484-35-9 | Thiodiethylene bis(3,5-di-tert-butyl-4-hydroxyhydrocinnamate |
| Irganox ® 1098 | 23128-74-7 | N,N'-Hexamethylene bis(3,5-di-tert-butyl-4-hydroxyhydrocinnamamide |
| Irganox ® B1171 | | 31570-04-4 |
| | 23128-74-7 | 1:1 Blend of Irganox ® 1098 and Irgafos ® 168 |
| Irganox ® 1425 | 65140-91-2 | Calcium bis(monoethyl(3,5-di-tert-butyl-4-hydroxybenzyl)phosphonate) |
| Irganox ® 3114 | 65140-91-2 | Calcium bis(monoethyl(3,5-di-tert-butyl-4-hydroxybenzyl)phosphonate) |
| Irganox ® 3125 | 34137-09-2 | 3,5-Di-tert-butyl-4-hydroxy-hydrocinnamic acid triester with 1,3,5-tris(2-hydroxyethyl)-S-triazine-2,4,6-(1H, 3H, 5H)-trione |
| Irgafos ® 168 | 31570-04-4 | Tris(2,4-di-tert-butyl-phenyl)phosphite |

Examples of reductive agents include sodium borohydride, hypophosphorous acid, Irgafos® 168, and mixtures thereof.

Process

The process for making a liquid fabric softening composition according to the invention comprises the steps of:

a)-mixing and heating the fabric softener active and optional additives to form a melt;

b)-dispersing the melt in water;

c)-cooling the resulting dispersion to below the Krafft temperature of the softener active before adding a dye and a nonionic stabilising agent.

By Krafft temperature, it is meant the temperature at which the solubility of the surfactant becomes equal to the critical micelle concentration (CMC), the CMC being defined in M.J ROSEN, Surfactants and interfacial phenomena, 1988, p.215.

Typically, the product is cooled to below 25° C.

Preferably, the mixing of Step a of the invention process is typically made with a marine type mixing impeller for 2 minutes. The dispersion of step b of the process is conveniently made using a flat blade turbine impeller at 100 rpm for 10 minutes, the viscosity being measured using a Brookfield LVT viscositymeter.

The cooling step as defined under c) is conveniently made using a plate heat exchanger ($\alpha$ level) at about 30 ton/hour using a positive displacement pump.

The dye and nonionic stabilising agent is mixed in the cooled product using a marine type mixing impeller.

In another aspect of the invention, there is provided the use of said nonionic ethoxylated stabilising agent in liquid fabric softening compositions as a freeze-thaw recovery agent.

By "freeze-thaw recovery agent", it is meant that the resulting product still exhibits effective dispersibility property after prolonged exposure to freeze-thaw temperatures.

Still in another aspect, the present invention encompasses the use of a nonionic alkoxylated stabilising agent to homogenise the dye in liquid fabric softening compositions.

The invention is illustrated in the following non limiting examples, in which all percentages are on a weight basis unless otherwise stated.

In the examples, the abbreviated component identifications have the following meanings:

DEQA: Di-(tallowyl-oxy-ethyl)dimethyl ammonium chloride

DTDMAC: Ditallow dimethylammonium chloride
Fatty acid: Tallow fatty acid IV=18
Electrolyte: Calcium chloride
PEG: Polyethylene Glycol 4000
IPA: Isopropyl alcohol
Nonionic: Marlipal 24/100 commercially available from Huls

EXAMPLE

The following resulting compositions were prepared in accordance with the process invention:

| Component | A | B | C | D | E |
|---|---|---|---|---|---|
| DTDMAC | — | — | — | — | 4.5 |
| DEQA (85% IPA) | 2.6 | 5.1 | 6.35 | 4.12 | — |
| Fatty acid | — | — | — | 0.2 | — |
| Nonionic | 0.1 | 0.25 | 0.3 | 0.35 | 0.25 |
| Hydrochloride acid | 0.02 | 0.02 | 0.02 | 0.02 | 0.02 |
| Perfume | 0.10 | 0.15 | 0.21 | 0.28 | 0.25 |
| Silicone antifoam | 0.005 | 0.005 | 0.005 | 0.005 | 0.01 |
| Dye (ppm) | 10 | 10 | 5 | 5 | 10 |
| Water and minors to balance to 100 | | | | | |

What is claimed is:

1. A process for making a liquid fabric softening composition which comprises the steps of:

a)-mixing and heating the fabric softener active and optional additives to form a melt;

b)-dispersing the melt in water;

c)-cooling the resulting dispersion to below the Krafft temperature of the softener active before adding a dye and a nonionic, alkoxylated stabilising agent.

2. A process according to claim 1, wherein said nonionic stabilising agent is selected from:

$$R^2—Y—(C_2H_4O)_z—C_2H_4OH$$

wherein $R^2$ is selected from the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; wherein Y is —O—, —C(O)O—, —C(O)N(R)—, or —C(O)N(R)R—, and wherein z is at least 5.

3. A process according to claim 2, wherein said hydrocarbyl group of the nonionic stabilising agent has a chain length of from 8 to 20 carbon atoms.

4. A process according to claim 1, wherein said nonionic stabilising agent is selected from the group consisting of straight-chain primary alcohol alkoxylates, straight-chain secondary alcohol alkoxylates, alkyl phenol alkoxylates, olefinic alkoxylates branched chain alkoxylates and mixtures thereof.

5. A process according to claim 1, wherein said nonionic alkoxylated stabilising agent is incorporated into the cold finished fabric softening composition at a level of 0.05% to 5% by weight of the liquid softening composition.

6. A process according to claim 1, wherein a perfume is added to the cold finished product.

7. A process according to claim 3, wherein said hydrocarbyl group of the nonionic stabilising agent has a chain length of from 10 to 18 carbon atoms.

* * * * *